US007220194B1

(12) United States Patent
Laiacona, Jr. et al.

(10) Patent No.: US 7,220,194 B1
(45) Date of Patent: May 22, 2007

(54) PITCHING PRACTICE TARGET

(76) Inventors: Anthony E. Laiacona, Jr., 27 Westbury Ct., Clifton Park, NY (US) 12065; Laura J. Laiacona, 27 Westbury, Clifton Park, NY (US) 12065

( * ) Notice: Subject to any disclaimer, the term of this patent is extended or adjusted under 35 U.S.C. 154(b) by 235 days.

(21) Appl. No.: 10/999,430

(22) Filed: Nov. 30, 2004

(51) Int. Cl.
*A63B 69/00* (2006.01)

(52) U.S. Cl. ..... 473/454

(58) Field of Classification Search ..... 473/420, 473/416, 454–456; 248/545, 156, 167, 411; 40/607.06, 604, 607.04, 607.09, 607.1, 610
See application file for complete search history.

(56) References Cited

U.S. PATENT DOCUMENTS 2,374,021 A * 4/1945 Torkel ..... 248/411
2,921,763 A * 1/1960 Miller, et al. ..... 248/121
3,658,329 A 4/1972 Ciccavello
3,871,647 A 3/1975 Tellez
3,997,158 A * 12/1976 Britton ..... 473/454
4,249,715 A * 2/1981 Repp ..... 248/545
4,254,952 A * 3/1981 Playter, Jr. ..... 473/456
4,783,070 A 11/1988 Bauer et al.
5,320,343 A 6/1994 McKinney
5,484,145 A 1/1996 Shriver
5,502,910 A * 4/1996 Lucchesi ..... 40/607.06
5,505,443 A 4/1996 Padilla
6,093,120 A 7/2000 Luke, Jr.
6,620,065 B2 9/2003 Clabough

* cited by examiner

*Primary Examiner*—Eugene Kim
*Assistant Examiner*—M. Chambers

(57) ABSTRACT

Pitching practice targets teach a pitcher to deliver accurate pitches. A tripod assembly is attached to one end of a body. The height of the pitching practice target can be adjusted by telescoping first and second body extensions inserted into the body's opposing end and telescoping lower legs inserted into the upper legs of the tripod assembly. The upper legs are hingedly attached to the body so that they can be folded up when not in use. An arm collar attaches one end of an arm to the second body extension. A target is suspended from the arm by chains hung from chain hooks. A target retainer connects the bottom edge of the target to the body's opposing end. The opposing end of the arm is bent at an angle and forms a triangular structure in conjunction with an arm support.

2 Claims, 3 Drawing Sheets

PITCHING PRACTICE TARGET

BACKGROUND OF THE INVENTION

1. Field of the Invention

The present invention relates to a pitching practice target for use in connection with baseball training. The pitching practice target has particular utility in connection with teaching a pitcher to deliver accurate pitches.

2. Description of the Prior Art

Pitching practice targets are desirable for teaching a pitcher to deliver accurate pitches. In order to be successful, pitchers must be able to place a thrown baseball with a high degree of accuracy. Live batters are usually not available for the large number of repetitions required. Pitching practice targets provide a simulated batter and a visual indication of the strike zone to help pitchers improve their skills. Unlike the prior art, pitching practice targets cover the strike zone with a target instead of merely defining the exterior boundaries of the strike zone with a frame. Furthermore, pitching practice targets can be used with a live catcher unlike the prior art.

The use of target teaching aids is known in the prior art. For example, U.S. Pat. No. 4,783,070 to Bauer et al. discloses a target teaching aid. However, the Bauer et al. '070 patent does not fold up, and has further drawbacks of lacking a target that covers the strike zone.

U.S. Pat. No. 5,320,343 to McKinney discloses a combination batting practice tee and pitching target that functions as a batting tee and swing corrector or as a pitching target. However, the McKinney '343 patent does not fold up, and additionally does not have target that covers the strike zone.

Similarly, U.S. Pat. No. 5,505,443 to Padilla discloses a combination ball-hitting and pitching practice apparatus that adjustably mounts a ball rebound net as well as means for practicing hitting stationery balls. However, the Padilla '443 patent does not fold up, and cannot be used with a live catcher.

In addition, U.S. Pat. No. Des. 350,569 to Boteler discloses a baseball pitching target that provides a target for pitching baseballs. However, the Boteler '569 patent does not fold up, and also cannot be used with a live catcher.

Furthermore, U.S. Pat. No. 5,484,145 to Shriver discloses a portable pitching aid that aids a pitcher in learning the art of pitching. However, the Shriver '145 patent does not fold up, and further lacks a target that covers the strike zone.

U.S. Pat. No. 3,871,647 to Tellez discloses an adjustable height baseball batter dummy that provides a pitcher with a realistic target when practicing hit pitches. However, the Tellez '647 patent does not fold up, and has the additional deficiency of lacking a target that covers the strike zone.

In addition, U.S. Pat. No. 3,658,329 to Ciccarello discloses a swingable strike zone baseball device that provides a practice device for baseball pitchers. However, the Ciccarello '329 patent does not fold up, and also does not have a target that covers the strike zone.

Furthermore, U.S. Pat. No. 6,620,065 to Clabough discloses a pitcher's box pitcher training system that trains all types of pitchers. However, the Clabough '065 patent does not fold up, and further lacks the ability to define the strike zone.

Lastly, U.S. Pat. No. 6,093,120 to Luke, Jr. discloses a baseball pitching and throwing training apparatus that simulates a strike zone or a target area. However, the Luke, Jr. '120 patent does not have target that covers the strike zone, and has the additional deficiency of not being usable with a live catcher.

While the above-described devices fulfill their respective, particular objectives and requirements, the aforementioned patents do not describe a pitching practice target that allows teaching a pitcher to deliver accurate pitches. The Bauer et al. '070 patent, the McKinney '343 patent, the Padilla '443 patent, the Boteler '569 patent, the Shriver '145 patent, the Tellez '647 patent, the Ciccarello '329 patent, and the Clabough '065 patent make no provision for folding up. The Bauer et al. '070 patent, the McKinney '343 patent, the Shriver '145 patent, the Tellez '647 patent, the Ciccarello '329 patent, and the Luke, Jr. '120 patent lack a target that covers the strike zone. The Padilla '443 patent, the Boteler '569 patent, and the Luke, Jr. '120 patent cannot be used with a live pitcher. The Clabough '065 patent cannot define the strike zone.

Therefore, a need exists for a new and improved pitching practice target that can be used for teaching a pitcher to deliver accurate pitches. In this regard, the present invention substantially fulfills this need. In this respect, the pitching practice target according to the present invention substantially departs from the conventional concepts and designs of the prior art, and in doing so provides an apparatus primarily developed for the purpose of teaching a pitcher to deliver accurate pitches.

SUMMARY OF THE INVENTION

In view of the foregoing disadvantages inherent in the known types of target teaching aids now present in the prior art, the present invention provides an improved pitching practice target, and overcomes the above-mentioned disadvantages and drawbacks of the prior art. As such, the general purpose of the present invention, which will be described subsequently in greater detail, is to provide a new and improved pitching practice target which has all the advantages of the prior art mentioned heretofore and many novel features that result in a pitching practice target which is not anticipated, rendered obvious, suggested, or even implied by the prior art, either alone or in any combination thereof.

To attain this, the present invention essentially comprises a body with one end of a plurality of legs attached to one end and one end of an arm assembly removably connected to its opposing end. A target is removably connected to the arm assembly's opposing end, wherein the target defines and completely covers a strike zone and permits a thrown ball to pass through the strike zone.

There has thus been outlined, rather broadly, the more important features of the invention in order that the detailed description thereof that follows may be better understood and in order that the present contribution to the art may be better appreciated.

The invention may also include the target being attached to the arm assembly by a plurality of chain hooks and a plurality of chains. The target may be made of mesh. Each of the legs may comprise an upper leg with one end attached to the end of the body, a lower leg with one end slidably inserted into the opposing end of the upper leg, a plurality of locking holes defined by holes in the opposing end of the upper leg and the end and the middle of the lower leg, and a locking pin removably inserted through the locking hole in the upper leg and one of the locking holes in the lower leg. There may be a leg collar slidably encircling the body, a leg collar thumbscrew threadedly connected to the leg collar, and a plurality of supports with one end pivotably connected to the leg collar and their opposing end pivotably connected to the middle of the legs. There may be a plurality of nonskid pads attached to the legs' opposing end. The arm assembly may comprise an arm collar slidably and removably encircling the opposing end of the body, an arm collar thumbscrew threadedly connected to the arm collar, an arm with one end attached to the arm collar, and an arm support with one end attached to the opposing end of the arm and its opposing end attached to the middle of the arm. The end of the legs may be connected to the end of the body by a plurality of hinges. There may be a locking clip connected to the opposing end of the body and a target retainer with one end removably connected to the locking clip and its opposing end attached to the target. There may be a first body extension with one end slidably inserted into the opposing end of the body and a second body extension with one end slidably inserted into the opposing end of the first body extension. The arm assembly may have one end slidably and removably attached to the opposing end of the second body extension. There may be a plurality of chain hooks, wherein one of the chain hooks is attached to the middle of the arm assembly and one of the chain hooks is attached to the opposing end of the arm assembly. There may be a plurality of chains with one end removably connected to the chain hooks. The target may be removably connected to the opposing end of the chains. The invention may have a tripod assembly with one end connected to one end of the body. The tripod assembly may comprise three upper legs with one end hingedly attached to the end of the body, three lower legs with one end slidably inserted into the opposing end of the upper legs, a plurality of locking holes defined by holes in the opposing end of the upper legs and the end and the middle of the lower legs, three locking pins removably inserted through the locking hole in the upper legs and one of the locking holes in the lower legs, a leg collar slidably encircling the body, a leg collar thumbscrew threadedly connected to the leg collar, and a plurality of supports with one end pivotably connected to the leg collar and their opposing end pivotably connected to the middle of the upper legs. There may be a plurality of nonskid pads attached to the opposing end of the lower legs. The arm assembly may comprise an arm collar slidably and removably encircling the opposing end of the second body extension, an arm collar thumbscrew threadedly connected to the arm collar, an arm with one end attached to the arm collar, wherein the opposing end of the arm is bent at an angle, and an arm support having opposing ends with one end attached to the opposing end of the arm and its opposing end attached to the middle of the arm. There may be a carrying strap removably encircling the tripod assembly, the body, the first body extension, and the second body extension. The target may be generally rectangular in shape. The tripod assembly, the body, the first body extension, and the second body extension may be selected from the group consisting of aluminum, stainless steel, and PVC tubing. There are, of course, additional features of the invention that will be described hereinafter and which will form the subject matter of the claims attached.

Numerous objects, features, and advantages of the present invention will be readily apparent to those of ordinary skill in the art upon a reading of the following detailed description of presently current, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved pitching practice target that has all of the advantages of the prior art target teaching aids and none of the disadvantages.

It is another object of the present invention to provide a new and improved pitching practice target that may be easily and efficiently manufactured and marketed.

An even further object of the present invention is to provide a new and improved pitching practice target that has a low cost of manufacture with regard to both materials and labor, and which accordingly is then susceptible of low prices of sale to the consuming public, thereby making such pitching practice target economically available to the buying public.

Still another object of the present invention is to provide a new pitching practice target that provides in the apparatuses and methods of the prior art some of the advantages thereof, while simultaneously overcoming some of the disadvantages normally associated therewith.

Even still another object of the present invention is to provide a pitching practice target for teaching a pitcher to deliver accurate pitches. This allows the invention to be used with a live catcher.

Still yet another object of the present invention is to provide a pitching practice target for teaching a pitcher to deliver accurate pitches. This makes it possible to simulate the strike zone for a left-handed or a right-handed batter An additional object of the present invention is to provide a pitching practice target for teaching a pitcher to deliver accurate pitches. This allows the location of the strike zone to be adjusted.

A further object of the present invention is to provide a pitching practice target for teaching a pitcher to deliver accurate pitches. This allows the pitching practice target to be easily stored and carried when not in use.

Lastly, it is an object of the present invention to provide a new and improved pitching practice target for teaching a pitcher to deliver accurate pitches.

These together with other objects of the invention, along with the various features of novelty that characterize the invention, are pointed out with particularity in the claims annexed to and forming a part of this disclosure. For a better understanding of the invention, its operating advantages, and the specific objects attained by its uses, reference should be had to the accompanying drawings and descriptive matter in which there is illustrated current embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE CURRENT EMBODIMENT

Figure 1:
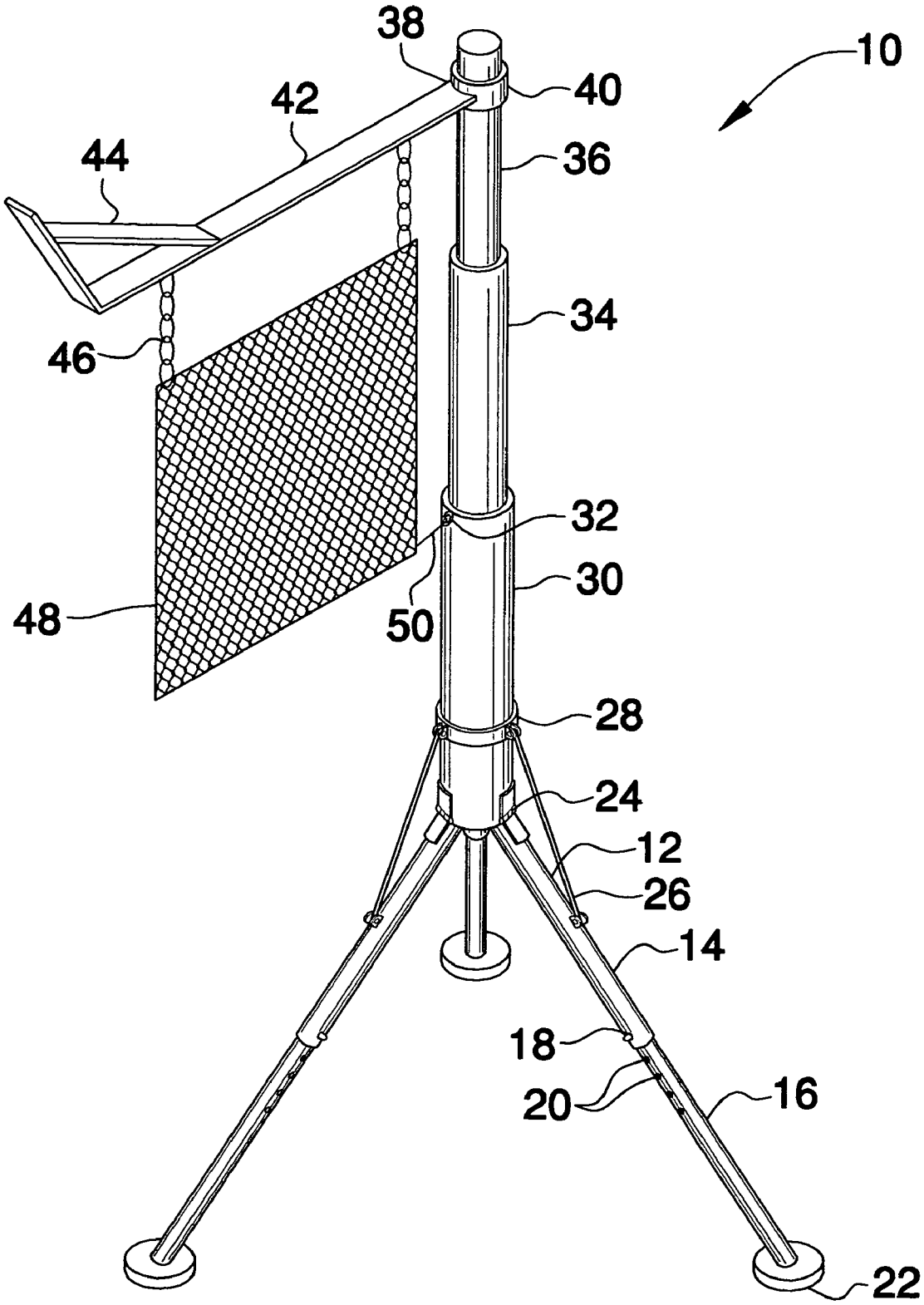
FIG. 1 is a top perspective view of the current embodiment of the pitching practice target constructed in accordance with the principles of the present invention.

Referring now to the drawings, and particularly to FIGS. 1–5, a current embodiment of the pitching practice target of the present invention is shown and generally designated by the reference numeral 10.

In FIG. 1, a new and improved pitching practice target 10 of the present invention for teaching a pitcher to deliver accurate pitches is illustrated and will be described. More particularly, the pitching practice target 10 has a tripod assembly 12 attached to one end of a body 30. The tripod assembly 12 has three upper legs 14 with one end hingedly attached by hinges 24 to one end of the body 30. A leg collar 28 slidably encircles the body 30 and has three supports 26 pivotably connected to it and to the middle of the upper legs 14. Three lower legs 16 have one end slidably inserted into the opposing end of the upper legs 14. The telescoping nature of the lower legs 16 and upper legs 14 allow the overall height of the body 30 to be adjusted and allows the pitching practice target 10 to remain level even if placed on uneven ground. The lower legs 16 are removably secured in place with respect to the upper legs 14 once locking pins 18 are removably inserted through the locking hole in the upper legs 14 and one of the locking holes 20 in the lower legs 16. A nonskid pad 22 is attached to the opposing end of each of the lower legs 16 to hold the pitching practice target 10 in place. The hinges 24, pivotably attached supports 26, and slidable leg collar 28 allow the upper legs to be folded up against the side of the body 30. A first body extension 34 has one end slidably inserted into the opposing end of the body 30, and a second body extension 36 has one end slidably inserted into the opposing end of the first body extension 34. The telescoping nature of the second body extension 36 and first body extension 34 allows the overall height of the pitching practice target 10 to be adjusted. An arm assembly 38 has an arm collar 40 slidably and removably encircling the second body extension 36. Two chains 46 have one end connected to an arm 42 with one end attached to the arm collar 40 by chain hooks 54 (not visible). The opposing end of the arm 42 is bent at an angle and has an arm support 44 connected to it to form a triangular structure. A target 48 hangs from the opposing end of the chains 46. A target retainer 50 removably attaches the bottom end of the target 48 to a locking clip 32 connected to the opposing end of the body 30. The target retainer 50 keeps target 48 from blowing in the wind. However, the target retainer 50 does not cause the target 48 to materially interfere with the passage of a pitched baseball (not shown). In the current embodiment, target 48 is made of a lightweight mesh. As a result, a live catcher (not shown) positioned behind the target 48 can catch a pitched baseball because he or she can see the baseball approaching through the target 48 and the baseball's trajectory is not materially altered by contact with the target 48. In the current embodiment, the tripod assembly 12, body 30, first body extension 34, and second body extension 36 are made of aluminum. In the current embodiment, the arm 42 is between 20 and 30 inches long, the leg span of the tripod assembly 12 is about 30 inches in diameter, and the body 30, first body extension 34, and second body extension 36 can be extended to a full height of between 4 and 6 feet.

Figure 2:
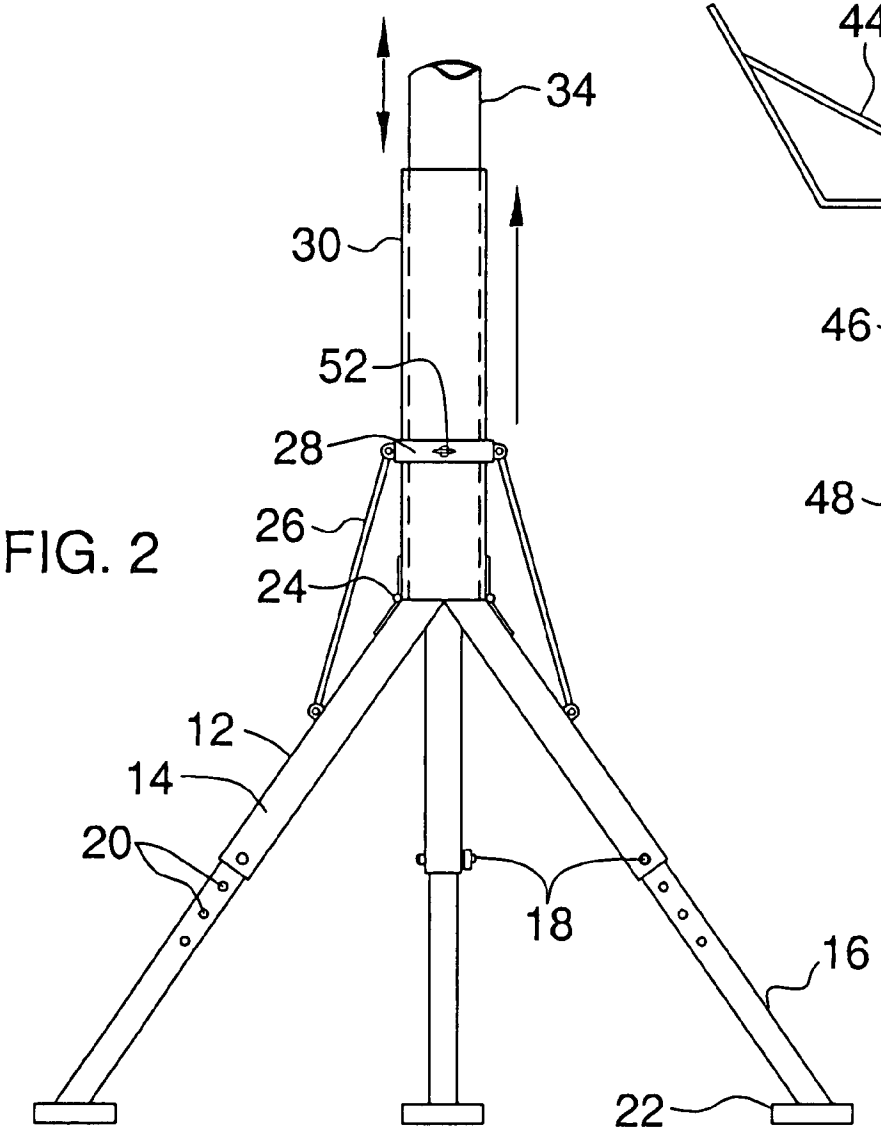
FIG. 2 is a side fragmentary view of the tripod assembly of the present invention.

Moving on to FIG. 2, a new and improved tripod assembly 12 of the present invention for teaching a pitcher to deliver accurate pitches is illustrated and will be described. More particularly, the tripod assembly 12 has three upper legs 14 with one end hingedly attached by hinges 24 to one end of the body 30. A leg collar 28 slidably encircles the body 30 and has three supports 26 pivotably connected to it and to the middle of the upper legs 14. A leg collar thumbscrew 52 is threadedly attached to the leg collar 28 and secures the leg collar 28 in place when desired. Three lower legs 16 have one end slidably inserted into the opposing end of the upper legs 14. The lower legs 16 are removably secured in place with respect to the upper legs 14 once locking pins 18 are removably inserted through the locking hole in the upper legs 14 and one of the locking holes 20 in the lower legs 16. A nonskid pad 22 is attached to the opposing end of each of the lower legs 16. A first body extension 34 has one end slidably inserted into the opposing end of the body 30.

Figure 3:
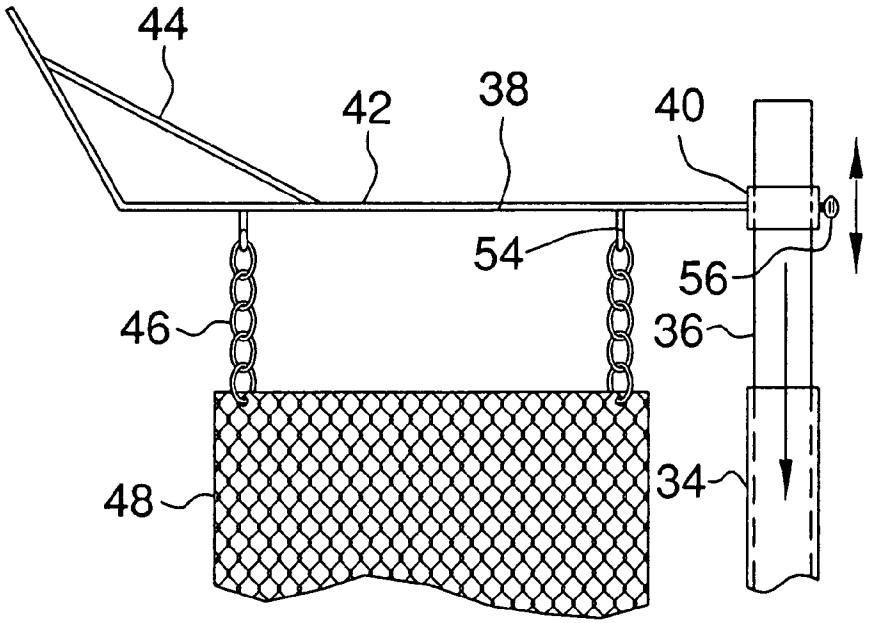
FIG. 3 is a side fragmentary view of the arm assembly of the present invention.

Continuing with FIG. 3, a new and improved arm assembly 48 of the present invention for teaching a pitcher to deliver accurate pitches is illustrated and will be described. More particularly, the arm assembly 48 has an arm collar 40 slidably and removably encircling the second body extension 36. The second body extension 36 has one end slidably inserted into the opposing end of the first body extension 34. The telescoping nature of the second body extension 36 and first body extension 34 allows the overall height of the pitching practice target 10 to be adjusted, and the slidably attached nature of the arm collar 40 allows the position of the arm assembly 38 to be adjusted. An arm collar thumbscrew 56 is threadedly attached to the arm collar 40 to secure it in place when desired. Two chains 46 have one end connected to an arm 42 with one end attached to the arm collar 40 by chain hooks 54. The opposing end of the arm 42 is bent at an angle and has an arm support 44 connected to it to form a triangular structure. A target 48 hangs from the opposing end of the chains 46.

Figure 4:
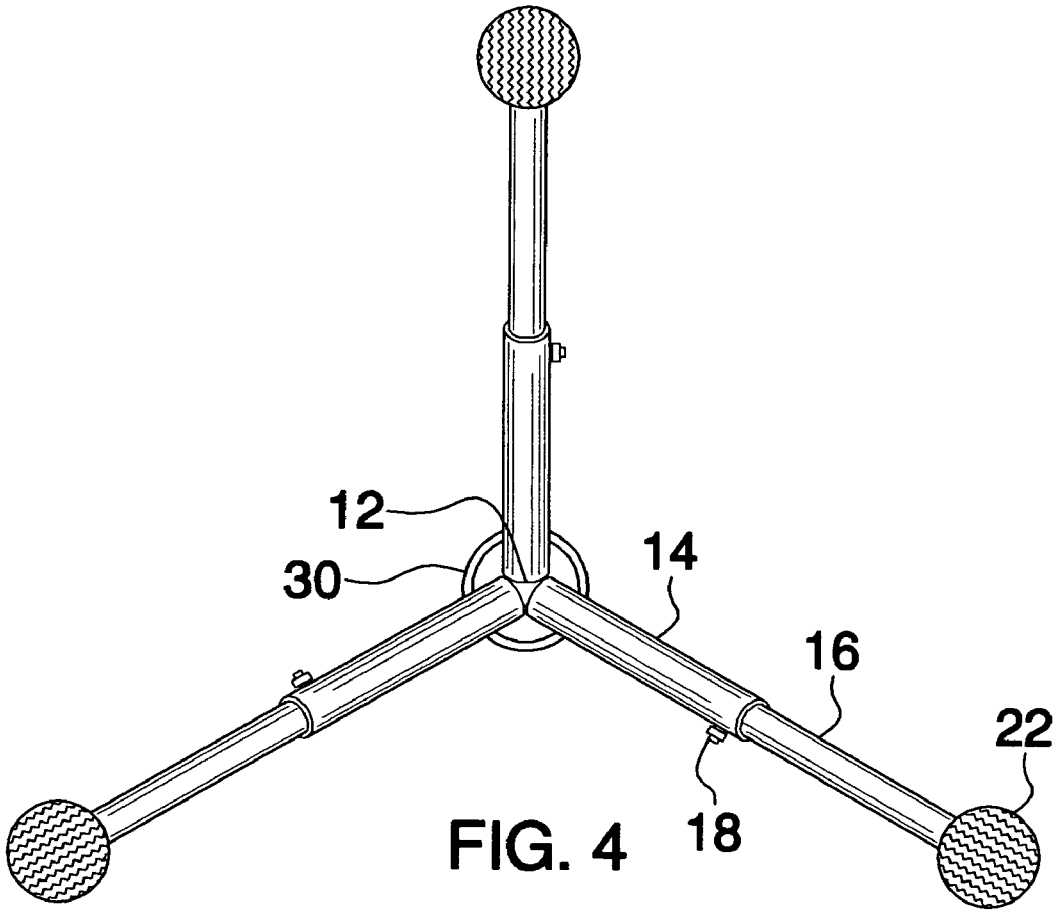
FIG. 4 is a bottom perspective view of the tripod assembly of the present invention.

In FIG. 4, a new and improved tripod assembly 12 of the present invention for teaching a pitcher to deliver accurate pitches is illustrated and will be described. More particularly, the tripod assembly 12 has three upper legs 14 with one end hingedly attached to one end of the body 30. Three lower legs 16 have one end slidably inserted into the opposing end of the upper legs 14. The lower legs 16 are removably secured in place with respect the upper legs 14 by locking pins 18. A nonskid pad 22 is attached to the opposing end of each of the lower legs 16.

Figure 5:
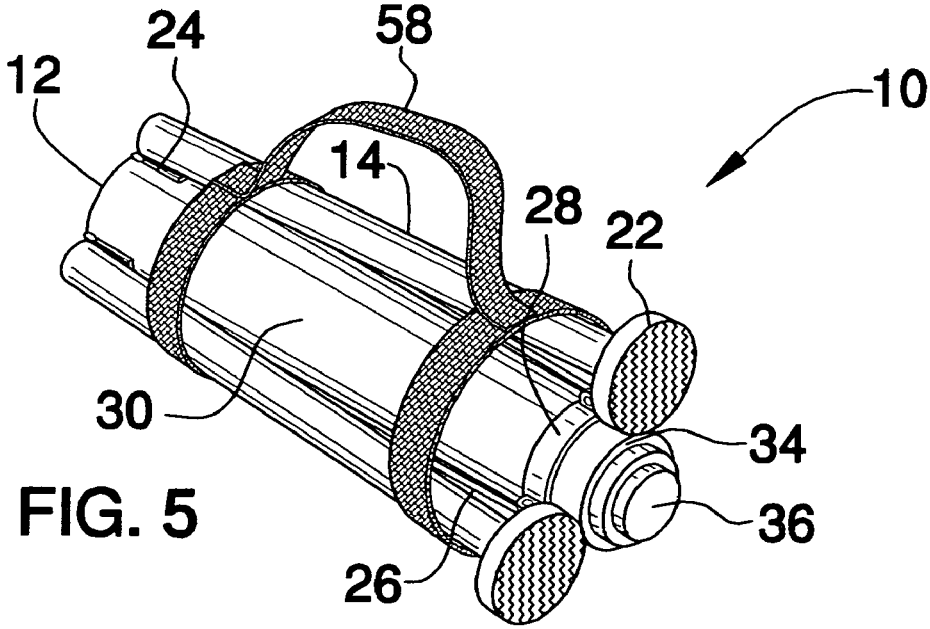
FIG. 5 is a top perspective view of the pitching practice target of the present invention.

Concluding with FIG. 5, a new and improved pitching practice target 10 of the present invention for teaching a pitcher to deliver accurate pitches is illustrated and will be described. More particularly, the pitching practice target 10 has a carrying strap 58 that encircles the upper legs 14, body 30, first body extension 34, and second body extension 36 when the pitching practice target 10 has its upper legs 14 folded up and the first body extension 34 and second body extension 36 retracted within the body 30. In its collapsed position, the pitching practice target 10 has its leg collar 28 slid up the body 30 and the supports 26 pivoted to allow the upper legs 14 to fold up against the body 30. The carrying strap 58 provides a convenient handle and prevents the pitching practice target 10 from opening undesirably.

In use, it can now be understood that the user removes the carrying strap 58 from around the pitching practice target 10 and prepares the pitching practice target 10 for use. This is accomplished by first unfolding the upper legs 14 and sliding the leg collar 28 down the body 30 to its desired position. The user uses leg collar thumbscrew 52 to secure the leg collar 28 in place. The user then pulls out each of the lower legs 16, adjusts them to their desired length, and inserts locking pins 18 through the locking hole in the upper legs 14 and one of the locking holes 20 in the lower legs 16 to secure them in place. The user then pulls out first body extension 34 and second body extension 36 from the body 30 to the desired height. The arm collar 40 is then slidably placed on the second body extension 36 and secured in position by arm collar thumbscrew 56. Finally, the target 48 is hung by chains 46 from chain hooks 54 and its bottom edge is connected to the locking clip 32 by target retainer 50. A pitcher can then practice pitching by throwing baseballs at the target 48. A live catcher can be positioned behind the target 48 if desired to catch the thrown baseballs. Once the pitching practice target 10 is no longer needed, the user reverses the above steps to collapse the pitching practice target 10 and prepare it for transport and/or storage.

While a current embodiment of the pitching practice target has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as stainless steel or PVC may be used instead of the aluminum described. Also, the mesh target may also be made of other light weight see-through materials. And although teaching a pitcher to deliver accurate pitches has been described, it should be appreciated that the pitching practice target herein described is also suitable for practicing other sports. Furthermore, a wide variety of leg arrangements may be used instead of the tripod assembly described.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A pitching practice target comprising:

a body having opposing ends;

three upper legs having opposing ends and a middle with one end hingedly attached to said end of said body;

three lower legs having opposing ends and a middle with one end slidably inserted into said opposing end of said upper legs;

three nonskid pads attached to said opposing end of said lower legs;

a plurality of locking holes, wherein said opposing end of said upper legs and said end and said middle of said lower legs define holes therein to comprise said locking holes;

three locking pins removably inserted through said locking hole in said upper legs and one of said locking holes in said lower legs;

a leg collar slidably encircling said body;

a leg collar thumbscrew threadedly connected to said leg collar, a plurality of supports having opposing ends with one end pivotably connected to said leg collar and said opposing end pivotably connected to said middle of said upper legs;

a first body extension having opposing ends with one end slidably inserted into said opposing end of said body;

a second body extension having opposing ends with one end slidably inserted into said opposing end of said first body extension;

an arm collar slidably and removably encircling said opposing end of said second body extension;

an arm collar thumbscrew threadedly connected to said arm collar;

an arm having opposing ends and a middle with one end attached to said arm collar, wherein said opposing end of said arm is bent at an angle;

an arm support having opposing ends with one end attached to said opposing end of said arm and said opposing end attached to said middle of said arm;

a plurality of chain hooks, wherein one of said chain hooks is attached to said middle of said arm and one of said chain hooks is attached to said opposing end of said arm;

a plurality of chains having opposing ends with one end removably connected to said chain hooks;

a target removably connected to said opposing end of said chains, wherein said target defines and completely covers a strike zone and permits a thrown ball to pass through said strike zone;

a locking clip connected to said opposing end of said body; and a target retainer having opposing ends with one end removably connected to said locking clip and said opposing end attached to said target.

2. The pitching practice target as defined in claim 1, further comprising a carrying strap removably encircling said tripod assembly, said body, said first body extension, and said second body extension.

* * * * *